US006571785B1

(12) United States Patent
Choma

(10) Patent No.: US 6,571,785 B1
(45) Date of Patent: Jun. 3, 2003

(54) SYSTEM FOR POSITIONING BOW LIMBS RELATIVE TO THE RISER OF A CROSSBOW

(75) Inventor: David A. Choma, Akron, OH (US)

(73) Assignee: Horton Manufacturing Company Inc., Tallmadge, OH (US)

( * ) Notice: Subject to any disclaimer, the term of this patent is extended or adjusted under 35 U.S.C. 154(b) by 0 days.

(21) Appl. No.: 09/978,268

(22) Filed: Oct. 16, 2001

(51) Int. Cl.[7] ..... F41B 5/12; F41B 5/00
(52) U.S. Cl. ..... 124/25; 124/23.1
(58) Field of Search ..... 124/23.1, 25.6, 124/25

(56) References Cited

U.S. PATENT DOCUMENTS

| | | | | |
|---|---|---|---|---|
| 4,674,468 A | * | 6/1987 | Izuta | |
| 5,280,779 A | | 1/1994 | Smith | 124/88 |
| 5,339,790 A | | 8/1994 | Smith | 124/25.6 |
| 5,487,373 A | | 1/1996 | Smith | 124/23.1 |
| 5,507,270 A | | 4/1996 | Smith | 124/23.1 |
| 5,515,836 A | * | 5/1996 | Martin et al. | 124/23.1 |
| 5,660,158 A | * | 8/1997 | Rudolph | 124/23.1 |
| 6,244,259 B1 | * | 6/2001 | Adkins | 124/23.1 |

* cited by examiner

*Primary Examiner*—John A. Ricci
(74) *Attorney, Agent, or Firm*—Renner, Kenner, Greive, Bobak, Taylor & Weber

(57) ABSTRACT

A crossbow (10) includes a riser (12) which is attached to an end of a limb (13) which extends longitudinally away from the riser (12). A pocket (24), having a sidewall (26) with the same peripheral shape of each limb (13), receives a limb (13). The pocket (24) and the limb (13) are configured so as to prevent longitudinal movement between the limb (13) and the pocket (24). One form of such configuration is a keyhole-shaped slot (18) in the limb (13) and a keyhole-shaped slot (31) in the pocket (24).

20 Claims, 4 Drawing Sheets

SYSTEM FOR POSITIONING BOW LIMBS RELATIVE TO THE RISER OF A CROSSBOW

TECHNICAL FIELD

This invention relates to a device for positioning the limbs of a crossbow relative to its riser and, in addition, has applicability to the attachment of the limbs of an archery bow to its handle.

BACKGROUND ART

Proper mounting of a bow limb to the riser of a crossbow is of prime importance to the efficient operation of the crossbow. The limbs are typically attached to the riser by a bolt which passes through a hole or slot in the limbs and is received in a threaded bore in the riser. A semicircular depression is formed in the riser which receives a half-round pivot member having its flat side attached to the limb. The underside of the limb does not touch the riser but rather rests on the half-round member about which the limb can pivot. The same type of arrangement is prevalent for mounting limbs to the handle of an archery bow.

There are many problems associated with this mounting arrangement, particularly when the bow is of the compound variety wherein the forces are magnified. Because most limbs are made of fiberglass, any intrusion thereof, such as the hole for the bolt, creates an area of fatigue substantially weakening the limb. Thus, if the half round member is attached to the limb by, for example, a bolt, another hole must be formed in the limb thereby further weakening it. To avoid this second intrusion of the limb, the half-round pivot member, which is usually made of plastic, is often glued to the limb. However, the large shear force created when the crossbow is cocked and when it is fired often causes a loosening of the pivot member.

Additionally, the placement of the pivot member is critical. Any slight misalignment of the pivot member causes the limbs to be misaligned with the riser which can increase the shear force. Thus, care must be taken when manufacturing the crossbows with these types of limb attachments so that the pivot member is properly positioned.

DISCLOSURE OF THE INVENTION

It is thus an object of the present invention to provide a system of positioning the limbs of a crossbow relative to its riser or the limbs of an archery bow relative to its handle.

It is another object of the present invention to provide a system, as above, which does not require any additional intrusions of the limbs, as by a hole or the like, other than the slot or hole required to attach an end of the limb to the riser.

It is a further object of the present invention to provide a system, as above, which will not weaken the limbs and which will permit them to be subjected to the additional forces created by a compound crossbow.

These and other objects of the present invention, as well as the advantages thereof over existing prior art forms, which will become apparent from the description to follow, are accomplished by the improvements hereinafter described and claimed.

In general, a crossbow made in accordance with the present invention includes a riser and at least one longitudinally extending limb having one end attached to the riser. A pocket receives the end of the limb and the pocket and the limb are configured so as to prevent longitudinal movement between the limb and the pocket.

A preferred exemplary system for attaching bow limbs to the riser of a crossbow incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
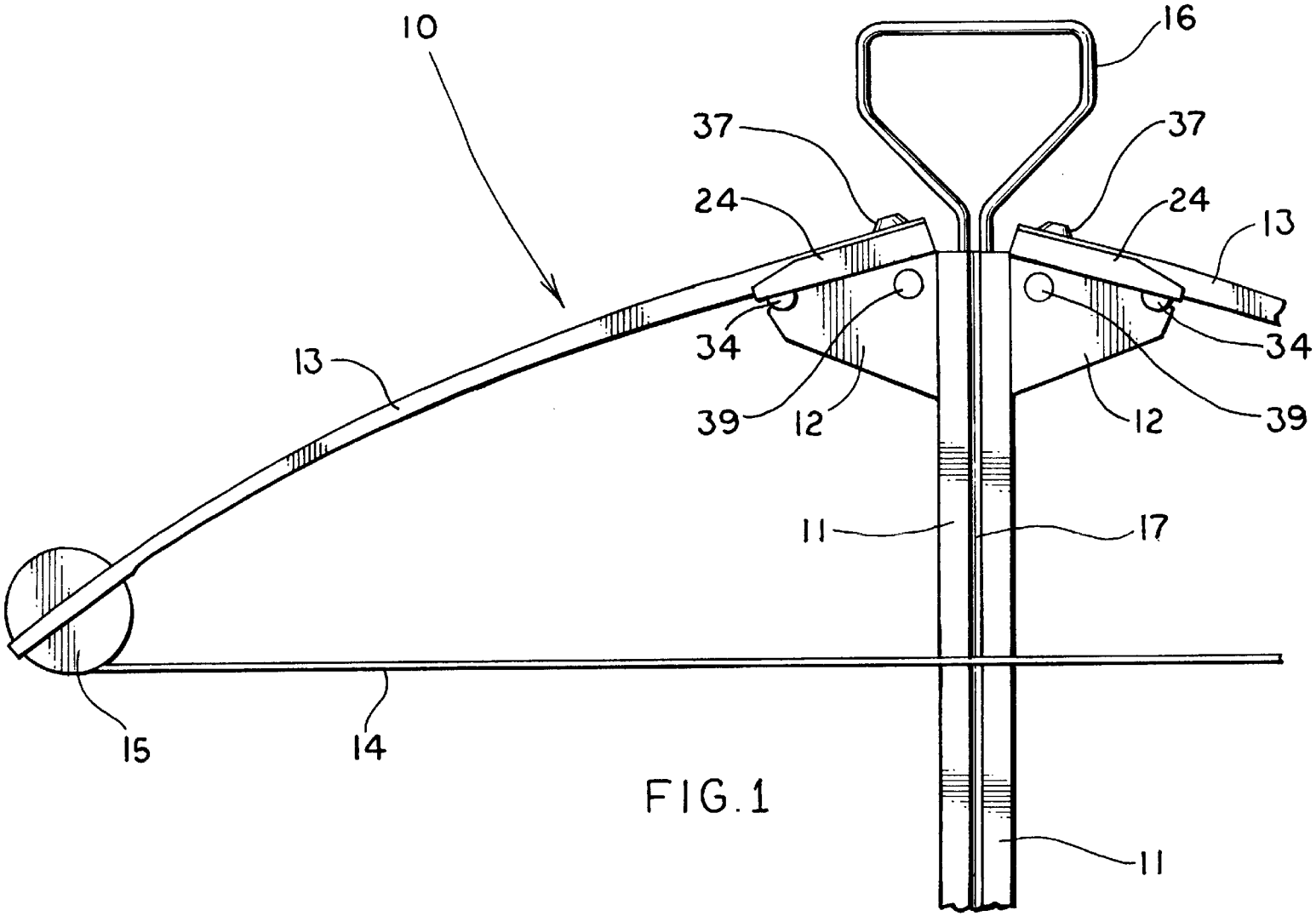
FIG. 1 is a somewhat schematic, fragmented plan view of a portion of a crossbow made in accordance with the present invention.
Figure 2:
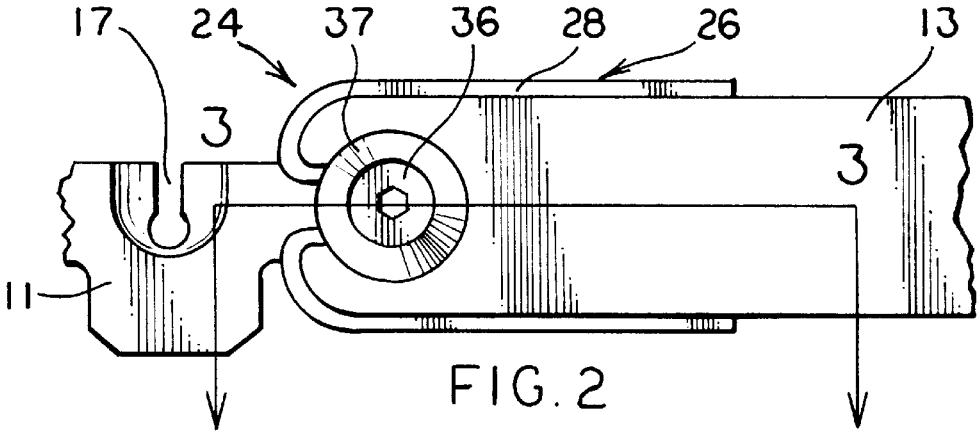
FIG. 2 is a fragmented, elevational view showing a limb as attached to the riser of the crossbow.

A crossbow made in accordance with the present invention is partially and schematically shown in FIG. 1 and is generally indicated by the numeral 10. Crossbow 10 includes an elongate barrel 11 carried at one end by a stock (not shown). The other end of barrel 11 carries a riser 12. Riser 12 carries the inner ends of crossbow limbs 13, and a bowstring 14 extends between the outer ends of limbs 13. If crossbow 10 is in the form of a compound bow, the outer ends of limbs 13 are provided with eccentric wheels or cams 15, and cables (not shown) will extend between cams 15 to render crossbow 10 easier to cock in a manner well known in the art. Crossbow 10 is also rendered easier to cock by virtue of a stirrup 16 mounted at the end of barrel 11. That is, by placing stirrup 16 on the ground and placing one's foot on it, bowstring 14 may be more easily withdrawn. Once crossbow 10 is cocked, an arrow may be placed in an arrow guide 17 formed in barrel 11, and upon activation of a trigger mechanism (not shown) carried by barrel 11, the arrow may be propelled.

The present invention relates to the manner in which the limbs 13 are positioned relative to riser 12. As previously discussed, such is preferably accomplished without damaging the integrity of the limbs 13, as by unnecessary holes or the like. In addition, the precise longitudinal (along the length of a limb 13) positioning as well as lateral positioning of limb 13, is important. It should also be noted that while the present invention is being described in conjunction with a crossbow 10, it has application to an archery bow as well wherein the limbs are attached to a handle.

Figure 6:
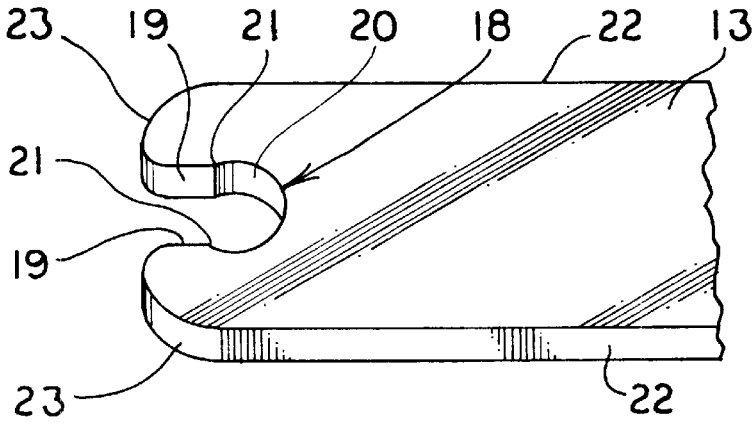
FIG. 6 is a fragmented perspective view of the end of a limb.

Each limb 13 is identical, with the configuration of its end which is attached to riser 12 being best shown in FIG. 6. Each limb 13 is shown as having a keyhole-shaped slot, generally indicated by the numeral 18, formed in the end thereof. Slot 18 is thus the only intrusion in limb 13 and forms opposed, generally parallel walls 19 connected at their inner ends by a partially circular wall 20. A shoulder 21 is formed at the junction of each wall 19 and circular wall 20. The outer periphery or perimeter of each limb 13 is thus defined by opposed, laterally spaced, parallel sidewalls 22 which have an arcuate wall 23 formed at the longitudinal ends thereof. Arcuate walls 23 end at walls 19 of slot 18 which, as just described, end at partially circular wall 20 thereby completing the outer peripheral surface of limb 13.

Figure 7:
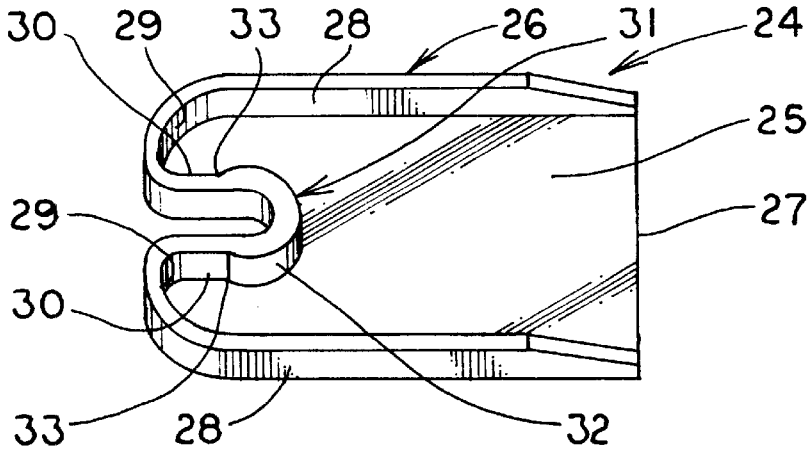
FIG. 7 is a perspective view of a pocket component of the present invention.

A limb pocket, best shown in FIG. 7 and generally indicated by the numeral 24, is provided to receive the end of each limb 13. Limb pocket 24 may be formed of any suitable plastic material, such as nylon or the like, and includes a base member 25 having a sidewall, generally indicated by the numeral 26, extending upwardly therefrom on three sides thereof. Thus, on the longitudinally inner side 27, pocket 24 is open and has no sidewall. The height of sidewall 26 generally corresponds to the thickness of limb 13, and the inner periphery of sidewall 26 preferably corresponds in configuration to the outer periphery of the end of each limb 13. Thus, the configuration of the inner periphery of sidewall 26 includes opposed, laterally spaced, parallel sidewall surfaces 28 which have an arcuate wall 29 formed at the longitudinal ends thereof. Arcuate walls 29 end at the opposed parallel walls 30 of a keyhole-shaped slot, generally indicated by the numeral 31. Pocket sidewall 26 includes the partially circular wall 32 of slot 31 which is positioned at the end of opposed parallel walls 30 thereby forming a shoulder 33 between wall 32 and walls 30.

Figure 8:
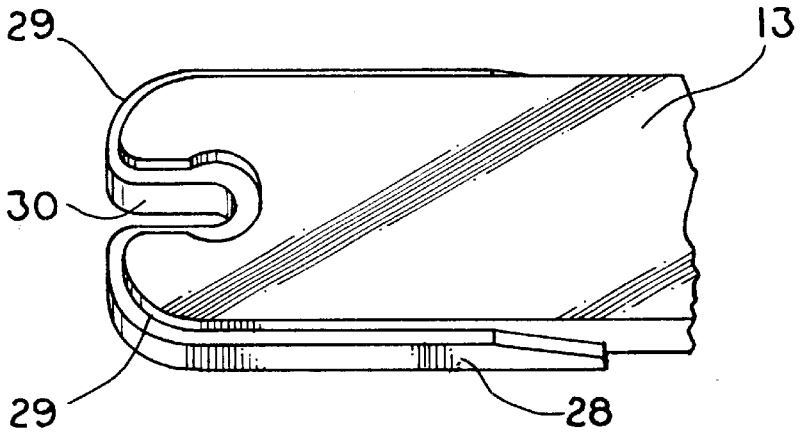
FIG. 8 is a fragmented perspective view of the elements of FIGS. 6 and 7 assembled.

The inner periphery of sidewall 26 of limb pocket 24 is slightly larger than the outer periphery of limb end 13 so that limb end 13 can be inserted into limb pocket 24 as shown in FIG. 8. As is evident, such insertion is accomplished by moving limb end 13 directly down onto base member 25 of pocket 24, and can only be accomplished if the peripheral configurations are aligned, such as keyhole-shaped slot 18 being aligned with keyhole-shaped slot 31. Once limb end 13 is positioned in pocket 24 as shown in FIG. 8, the longitudinal position of limb 13 relative to pocket 24 is established, that is, limb 13 cannot be longitudinally moved out of pocket 24 because of the interference of the keyhole-shaped slots 18 and 31. Specifically, shoulder 21 of limb end 13 will engage shoulder 33 of pocket sidewall 26 and constitute interfering members to prevent relative longitudinal movement.

However, the subject invention is not limited to this specific peripheral configuration or arrangement of interfering members. Rather, any configuration which will prohibit the relative longitudinal movement between limb 13 and pocket 24 is contemplated by this invention. For example, in the instance shown in the drawings, as long as any portions of the periphery of limb 13 are laterally spaced from each other a lesser distance than some portions of the periphery of the pocket sidewall 26 which is positioned closer to open side 27 than the portions of the periphery of limb 13, longitudinal movement will be prohibited. Thus, as shown in the drawings, walls 19 of the periphery of limb 13 are spaced from each other a lesser distance than portions of the circular wall 32 of pocket sidewall 26, with that circular wall 32 being positioned closer to the open side 27 than walls 19. In another configuration which would prohibit the relative longitudinal movement, as contemplated by the present invention, the limb 13 may have a lateral dimension larger than the lateral spacing of a portion of the pocket sidewall 26 which is positioned closer to the open side 27 than the larger lateral dimension of limb 13. As another example, even a lug extending upwardly from the pocket 24 to be received in an aperture formed in the limb 13 would prevent the relative longitudinal movement between the two components.

Figure 3:
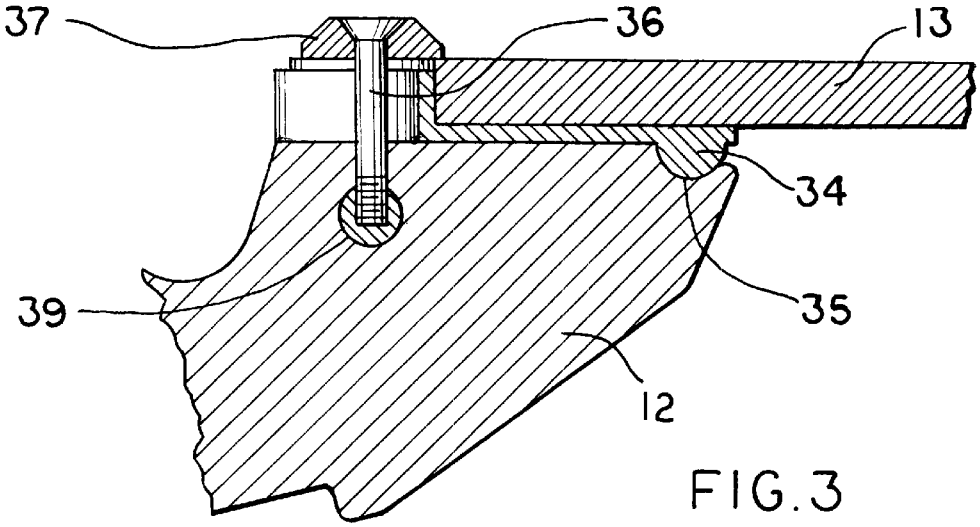
FIG. 3 is a sectional view taken substantially along line 3—3 of FIG. 2.
Figure 4:
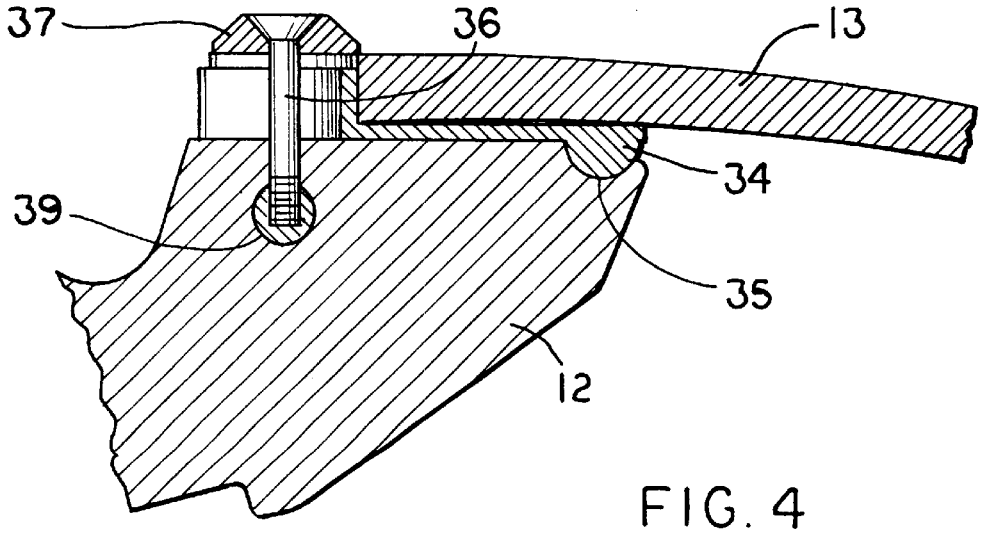
FIG. 4 is a sectional view similar to FIG. 3 but showing the limb in a cocked condition.
Figure 5:
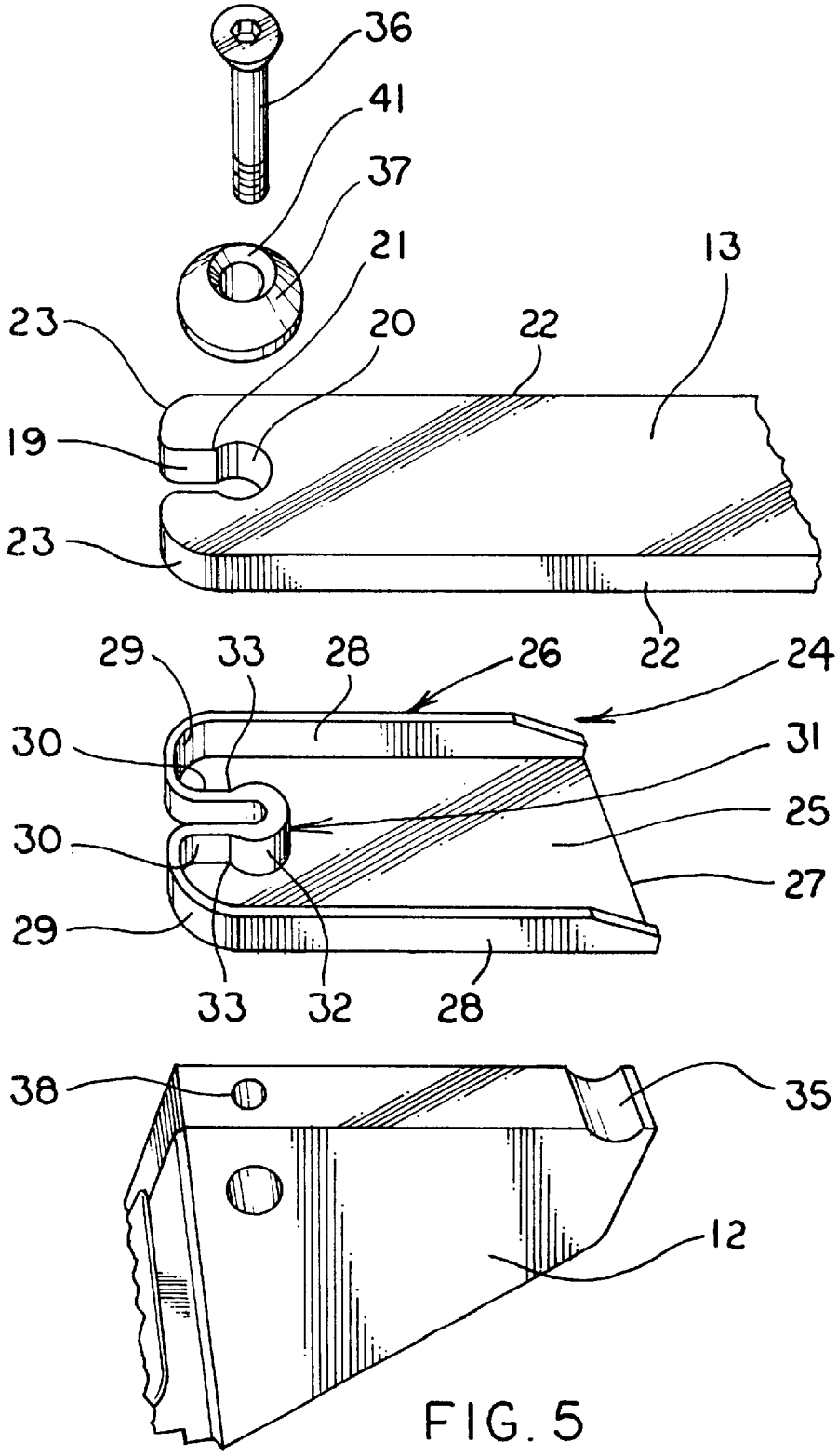
FIG. 5 is a fragmented, exploded view of a limb, riser and the components utilized to connect the limb to the riser.

Once the limb end 13 is placed in pocket 24 as shown in FIG. 8, the longitudinal positioning of the unit formed thereby relative to riser 12 can be readily established. Such is accomplished by virtue of a generally semi-spherical pivot 34 being formed on the bottom of pocket base member 25 near the open side 27 thereof. As best shown in FIGS. 3 and 4, pivot 34 is adapted to fit within a cradle 35 formed in riser 12. As such, limb 13 is positively located relative to riser 12 when the assembly is completed.

To that end, the limb/pocket unit of FIG. 8 is attached to riser 12 in a rather conventional manner by means of a bolt 36 which is slidably received through a washer-like member 37, through the circular wall portions 20, 32 of keyhole-shaped slots 18, 31 of limb 13 and pocket 24, respectively, and through a bore 38 formed in riser 12. A steel rod 39 is positioned in a bore 40 in riser 12 which is generally situated ninety degrees of bore 38. Rod 39 is drilled and tapped to receive the threaded lower end of bolt 36. Rod 39 thus acts as a nut for bolt 36.

When bolt 36 is fastened down as shown in FIG. 3, limb 13 is properly, positively positioned, laterally and longitudinally, relative to riser 12. When the crossbow is cocked, the components generally move from the FIG. 3 to the FIG. 4 position as limb 13 bends. At that time, pivot 34 rides in cradle 35 and the slots 18 and 31 prevent bolt 36 from binding. The inside conical surface 41 of washer-like member 37 allows it to pivot a bit when limb 13 is bent. But throughout all of this tensioning of limb 13, it and pocket 24 remain at the same longitudinal position relative to each other and to riser 12.

In view of the foregoing, it should be evident that a system for attaching the limbs of a crossbow to a riser, as described herein, accomplishes the objects of the present invention and otherwise substantially improves the art.

What is claimed is:

1. A crossbow comprising a riser, at least one longitudinally extending limb having one end attached to said riser, and a pocket receiving said end of said limb, said pocket and said end of said limb being configured so as to prevent longitudinal movement between said limb and said pocket.

2. A crossbow according to claim 1 wherein said riser includes a cradle and said pocket includes a generally semicircular pivot positioned in said cradle.

3. A crossbow according to claim 1 wherein said limb has a generally keyhole-shaped slot in said one end, said pocket having a similar keyhole-shaped slot at one end thereof.

4. A crossbow according to claim 1 wherein said pocket has a sidewall extending upwardly from three sides thereof, said sidewall having a peripheral shape matching the peripheral shape of said end of said limb.

5. A crossbow according to claim 4 wherein the peripheral shape of said limb includes a keyhole-shaped slot in said one end, and the peripheral shape of said pocket includes a keyhole-shape slot in one side opposite to the side not having a said sidewall.

6. A crossbow according to claim 5 wherein said riser includes a cradle and said pocket includes a generally semicircular pivot positioned in said cradle.

7. A crossbow according to claim 5 including a bolt slidably received through said keyhole-shaped slots and attached to said riser.

8. A crossbow comprising a riser, at least one limb having one end attachable to said riser and extending longitudinally away from said riser, and a pocket receiving said end of said limb, said limb and said pocket having interfering members to prevent said limb from longitudinally moving with respect to said pocket.

9. A crossbow according to claim 8 wherein said riser includes a cradle and said pocket includes a generally semicircular pivot positioned in said cradle.

10. A crossbow according to claim 8 wherein said interfering members include a keyhole-shaped slot in said one end of said limb received by a keyhole-shaped slot formed in said pocket.

11. A crossbow according to claim 8 wherein said pocket has a sidewall extending upwardly from three sides thereof, one side thereof being open.

12. A crossbow according to claim 11 wherein portions of said limb are laterally spaced from each other a lesser distance than some portions of the periphery of said sidewall of said pocket, said portions of the periphery of said sidewall of said pocket being closer to said open side of said pocket than said portions of said limbs.

13. A crossbow according to claim 12 wherein said portions of said limb include a portion of a keyhole-shaped slot, and said portions of the periphery of said sidewalls include a portion of a keyhole-shaped slot.

14. A crossbow according to claim 13 including a bolt slidably received through said keyhole-shaped slots and attached to said riser.

15. A system for positioning a limb of a bow longitudinally relative to another member comprising a pocket receiving an end of the limb and positioning the limb relative to the member, the limb and said pocket being configured so as to prevent longitudinal movement between the limb and said pocket.

16. A system according to claim 15 wherein said member includes a cradle and said pocket includes a generally semicircular pivot positioned in said cradle.

17. A system according to claim 15 wherein said limb has a generally keyhole-shaped slot in said one end, said pocket having a similar keyhole-shaped slot at one end thereof.

18. A system according to claim 15 wherein said pocket has a sidewall extending upwardly from three sides thereof, said sidewall having a peripheral shape matching the peripheral shape of said limb.

19. A system according to claim 18 wherein the peripheral shape of said limb includes a keyhole-shaped slot in said one end, and the peripheral shape of said pocket includes a keyhole-shape slot in one side opposite to the side not having a said sidewall.

20. A system according to claim 19 including a bolt slidably received through said keyhole-shaped slots and attached to said member.

* * * * *